US010906154B2

(12) United States Patent
Feng et al.

(10) Patent No.: US 10,906,154 B2
(45) Date of Patent: Feb. 2, 2021

(54) POLISHING PAD AND METHOD FOR MAKING THE SAME

(71) Applicant: SAN FANG CHEMICAL INDUSTRY CO., LTD., Kaohsiung (TW)

(72) Inventors: Chung-Chih Feng, Kaohsiung (TW); I-Peng Yao, Kaohsiung (TW); Chih-Yi Lin, Kaohsiung (TW); Tai-Yun Fu, Kaohsiung (TW); Yung-Chang Hung, Kaohsiung (TW); Jhih-Gong Lin, Kaohsiung (TW)

(73) Assignee: SAN FANG CHEMICAL INDUSTRY CO., LTD., Kaohsiung (TW)

( * ) Notice: Subject to any disclaimer, the term of this patent is extended or adjusted under 35 U.S.C. 154(b) by 448 days.

(21) Appl. No.: 15/879,841

(22) Filed: Jan. 25, 2018

(65) Prior Publication Data

US 2018/0147690 A1 May 31, 2018

Related U.S. Application Data

(62) Division of application No. 14/738,307, filed on Jun. 12, 2015, now abandoned.

(30) Foreign Application Priority Data

Nov. 17, 2014 (TW) ..... 103139819 A

(51) Int. Cl.

| | |
|---|---|
| ***B24B 37/24*** | (2012.01) |
| ***B24B 37/22*** | (2012.01) |
| ***B24D 18/00*** | (2006.01) |
| ***B24D 3/28*** | (2006.01) |

(52) U.S. Cl.
CPC ..... *B24B 37/24* (2013.01); *B24B 37/22* (2013.01); *B24D 3/28* (2013.01); *B24D 18/0027* (2013.01); *B24D 18/0063* (2013.01)

(58) Field of Classification Search
None
See application file for complete search history.

(56) References Cited

U.S. PATENT DOCUMENTS

2005/0129897 A1* 6/2005 Zhou ..... B32B 38/04 428/43
2007/0010175 A1* 1/2007 Feng ..... B24B 37/30 451/41

OTHER PUBLICATIONS

Office action and search report dated Dec. 4, 2017 by SIPO (State Intellectual Property Office of China) for the counterpart CN Patent Application No. 201510005851.X.
English translation of the search report dated Dec. 4, 2017 by SIPO (State Intellectual Property Office of China) for the counterpart CN Patent Application No. 201510005851.X.

* cited by examiner

*Primary Examiner* — Pegah Parvini
*Assistant Examiner* — Ross J Christie
(74) *Attorney, Agent, or Firm* — WPAT, P.C., Intellectual Property Attorneys; Anthony King

(57) ABSTRACT

The present invention relates to a polishing pad and a method for making the same. The polishing pad includes a base layer and a polishing layer. The base layer has a first surface and a second surface. The polishing layer is disposed on the first surface of the base layer and has a plurality of second fibers, a polymeric elastomer and a plurality of pores. The second fibers are arranged irregularly and cross each other to form the pores, and the polymeric elastomer is attached to the second fibers and does not fill the pores.

4 Claims, 3 Drawing Sheets

POLISHING PAD AND METHOD FOR MAKING THE SAME

BACKGROUND OF THE INVENTION

1. Field of the Invention

The present invention relates to a polishing pad and a method for making the same, and more particularly to a polishing pad having pore structure and a method for making the same.

2. Description of the Related Art

FIG. 1 is a schematic cross-sectional view of a conventional polishing pad. The method for making the conventional polishing pad 1 is described as follows. A polyurethane resin is formed on an upper surface 101 of a non-woven fabric 10. Then, the non-woven fabric 10 and the polyurethane resin are impregnated in a curing liquid of a coagulation tank, so as to cure the polyurethane resin and form a grinding layer 12, where the grinding layer 12 has an upper surface 121 and a plurality of cells 14. Then, the upper surface 121 of the grinding layer 12 is ground with a sandpaper, so as to produce a sense of fluff and enable the cells 14 to open on the upper surface 121 of the grinding layer 12, so as to manufacture a polishing pad 1.

The conventional polishing pad 1 has the following disadvantages: the foaminess of the cells 14 is relevant to many process parameters, for example, the concentration and the temperature of the curing liquid, the production speed of the machine table, and the like. If one process parameter is adjusted inaccurately, it is easy to cause defects of the polishing pad 1, for example, fiber protrusion (fibers of the non-woven fabric 10 protrude beyond the upper surface 121 of the grinding layer 12), fiber combination (a plurality of the above-mentioned protrusive fibers is combined together) or balloon (the grinding layer 12 has bubbles at the bottom thereof) and other problems. As a result, the yield of the polishing pad 1 is excessively low, and the manufacturing cost is increased. In addition, the impregnation time is excessively long, resulting in that the labor time of making the polishing pad 1 is excessively long accordingly.

Therefore, it is necessary to provide an innovative and progressive polishing pad and a method for making the same, so as to solve the above problems.

SUMMARY OF THE INVENTION

The present invention provides a polishing pad. The polishing pad comprises a base layer and a polishing layer. The base layer has a first surface and a second surface. The polishing layer is disposed on the first surface of the base layer and has a plurality of second fibers, a polymeric elastomer and a plurality of pores. The second fibers are arranged irregularly and cross each other to form the pores, and the polymeric elastomer is attached to the second fibers and does not fill the pores.

The present invention further provides a method for making a polishing pad. The method comprises the steps of: (a) providing a base layer, wherein the base layer has a first surface and a second surface; (b) heating a second polymeric material to a molten state; (c) spraying the second polymeric material in the molten state on the first surface of the base layer, wherein the second polymeric material forms a plurality of second fibers, and the second fibers are arranged irregularly and cross each other to form a plurality of pores; and (d) impregnating the second fibers in a third polymeric material, so that the third polymeric material is attached to the second fibers and does not fill the pores, so as to form a polishing layer.

Thereby, the second fibers are of a fluffy porous structure, and do not need to form the conventional cells; therefore, conventional fiber protrusion, fiber combination or balloon and other problems will not occur, which can thus improve the yield of the polishing pad and reduce the manufacturing cost. In addition, the shapes and sizes of the pores are uniform, so that the grinding slurry and the abrasive particles can easily come into and go out of the pores during the grinding process or polishing process. Further, it is not easy for the polishing pad to pill, and it is not easy to scratch a workpiece to be polished. Furthermore, the thickness of the polishing pad and the sizes of the pores are adjustable, and thus the polishing pad and the pores can be customized.

BRIEF DESCRIPTION OF THE DRAWINGS

The invention will be described according to the appended drawings in which.

PREFERRED EMBODIMENT OF THE INVENTION

The present invention provides a polishing pad. The polishing pad is used in a chemical mechanical polishing (CMP) process to polish or grind a workpiece to be polished. The workpiece to be polished is an object such as a semiconductor, a storage medium substrate, an integrated circuit (IC), an LCD flat glass, an optical glass, or a photoelectric panel.

Figure 1:
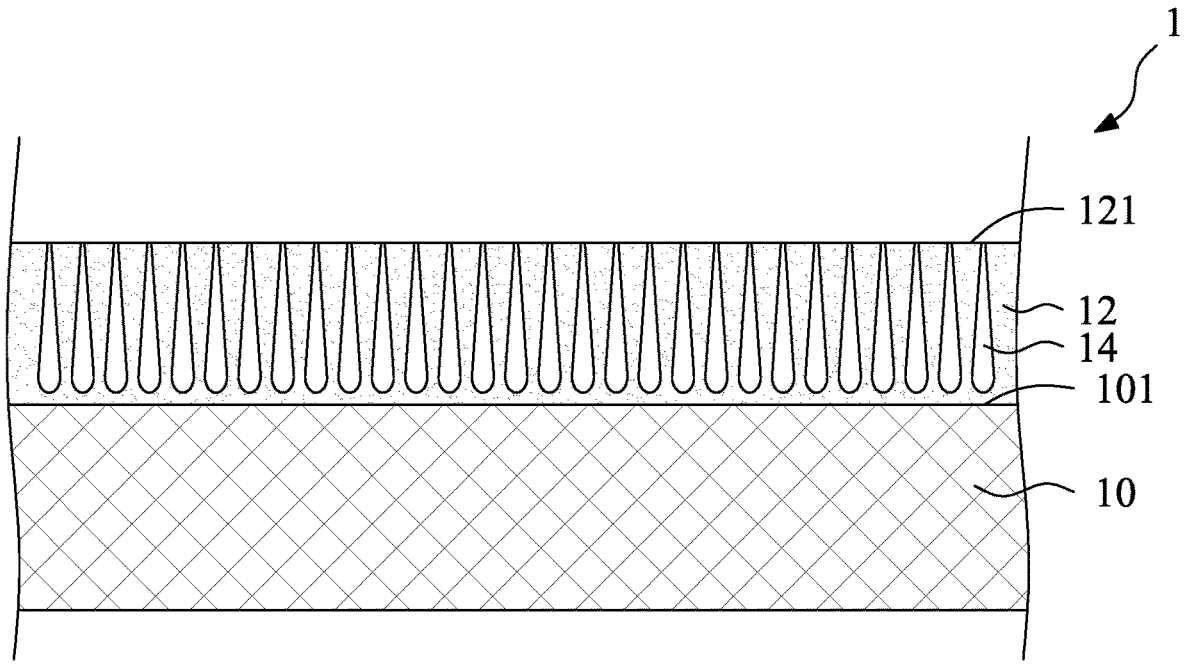
FIG. 1 is a schematic cross-sectional view of a conventional polishing pad.
Figure 2:
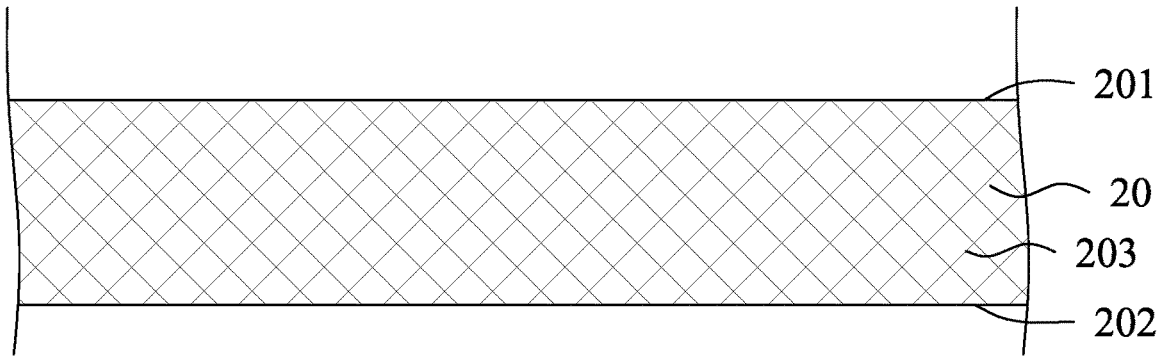
FIG. 2 to FIG. 5 are schematic views of process steps of a method for manufacturing a polishing pad according to an embodiment the present invention.

FIG. 2 to FIG. 5 are schematic views of process steps of a method for manufacturing a polishing pad according to an embodiment the present invention. Referring to FIG. 2, a base layer 20 is provided. The base layer 20 has a first surface 201, a second surface 202 and a plurality of first fibers 203. The first fibers 203 are formed by curing a first polymeric material, where the first polymeric material is selected from the group consisting of polyamide resin, polyethylene terephthalate (PET), nylon, polypropylene (PP), polyester resin, acrylic resin, polyacrylonitrile resin and thermoplastic urethane (TPU). The length of the first fibers 203 is 40 mm to 60 mm, preferably 51 mm, and the fiber fineness (e.g., diameter) of each of the first fibers 203 is 0.2 μm to 0.5 μm, preferably 0.4 μm.

Figure 3:
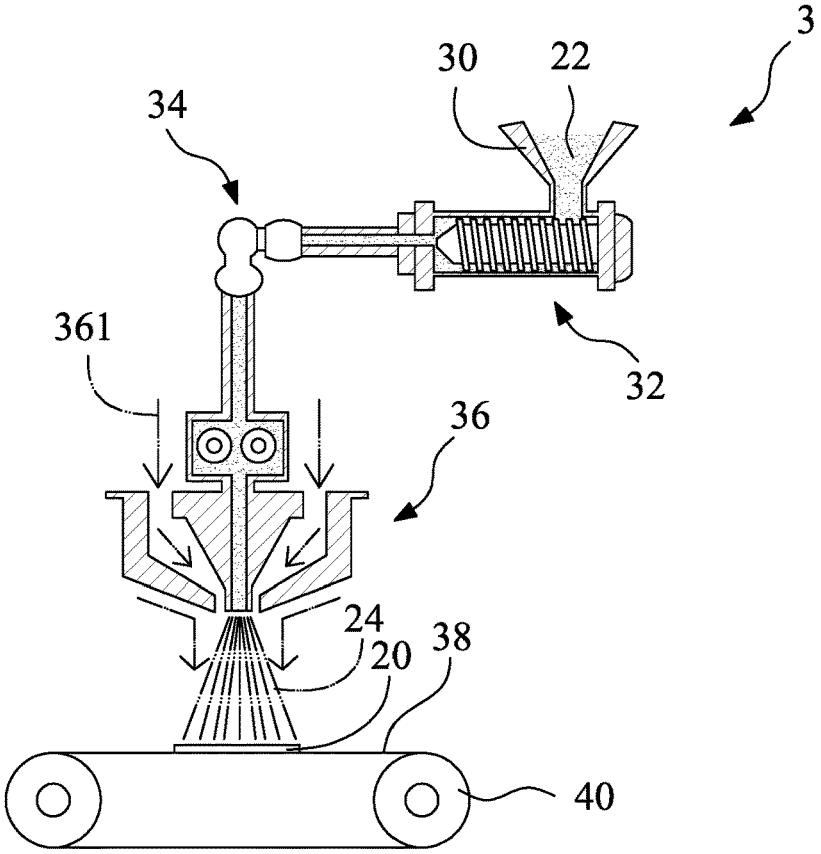

Referring to FIG. 3, a second polymeric material 22 and a melt blowing device 3 are provided. The second polymeric material 22 is selected from the group consisting of polyamide resin, polyethylene terephthalate (PET), nylon, polypropylene (PP), polyester resin, acrylic resin, polyacrylonitrile resin and thermoplastic urethane (TPU). The viscosity of the second polymeric material 22 is 1000 cps to 10000 cps.

The melt blowing device 3 includes a feeding zone 30, a heating zone 32, a transportation pipeline 34, a nozzle 36, a conveying belt 38 and two rotating wheels 40. The conveying belt 38 is used to carry the base layer 20, and the conveying belt 38 is driven by the rotating wheels 40 to be capable of driving the base layer 20 to move. The feeding zone 30 is used to accommodate the second polymeric material 22, and provide the second polymeric material 22 to the heating zone 32. The heating zone 32 is used to heat the second polymeric material 22 to a molten state, and transport the second polymeric material 22 in the molten state to the transportation pipeline 34. In this embodiment, the temperature of the heating zone 32 is above 250° C., and the heating time is 10 minutes to 15 minutes, preferably 10 minutes.

Then, the second polymeric material 22 in the molten state enters the nozzle 36 via the transportation pipeline 34. The nozzle 36 has a high pressure gas 361 therein, which is used to spray the second polymeric material 22 in the molten state on the first surface 201 of the base layer 20 located at the conveying belt 38 in a manner of injection molding, where the second polymeric material 22 forms a plurality of second fibers 24. After spraying, the second fibers 24 are arranged irregularly and cross each other to form a plurality of pores. The fiber fineness (e.g., diameter) of each of the second fibers 24 is 0.01 mm to 1 mm, and the length of the second fibers 24 is 50 mm to 60 mm, preferably 55 mm. In this embodiment, the length of the first fibers 203 is less than or equal to that of the second fibers 24. In this embodiment, the second fibers 24 are injected by using the nozzle 36, and there is a relative movement between the nozzle 36 and the base layer 20. That is, the nozzle 36 is stationary while the base layer 20 is movable, or the base layer 20 is stationary while the nozzle 36 is movable. In this embodiment, in the case of spraying the second fibers 24 at a time, the thickness formed by the second fibers 24 is about 0.02 mm to 2 mm, and thus, the number of times of back-and-forth spraying can be determined according to a required thickness.

Then, the second fibers 24 are cooled at a room temperature (25° C.), and the cooling time is 5 hours, so as to cure the second fibers 24. It is noted that, the second fibers 24 are arranged irregularly and cross each other to form a plurality of pores, and the pores are also arranged irregularly.

Figure 4:
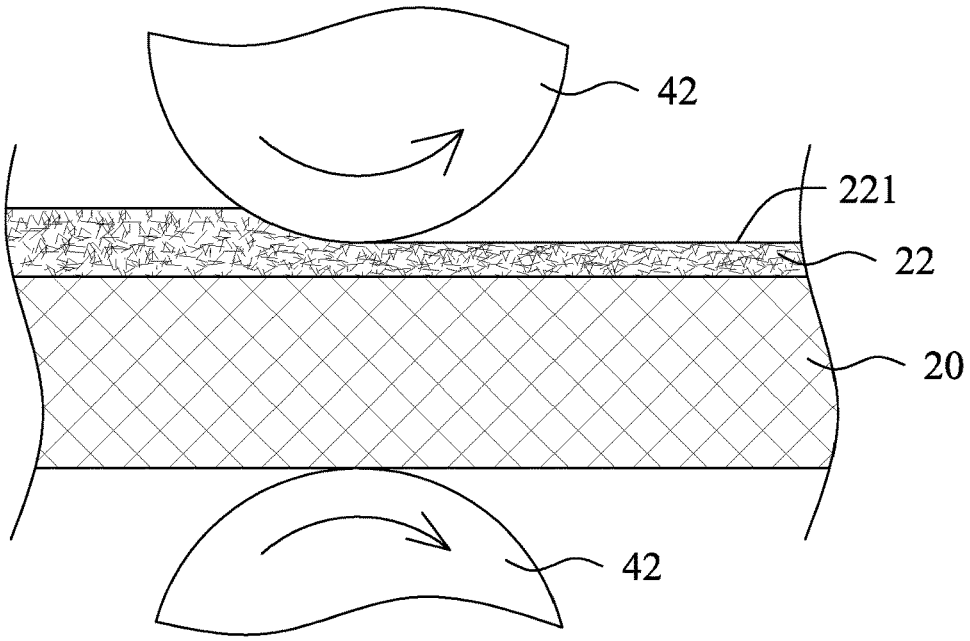

Then, the second fibers 24 are impregnated in a third polymeric material. The third polymeric material is selected from the group consisting of polyethylene terephthalate resin, oriented polypropylene resin, polycarbonate resin, polyamide resin, epoxy resin, phenolic resin, polyurethane resin, polystyrene resin and acrylic resin. The viscosity of the third polymeric material is 200 cps to 300 cps. That is, the viscosity of the second polymeric material 22 is greater than that of the third polymeric material, so that the third polymeric material may be only attached to the second fibers 24 and does not fill the pores, so as to form a polishing layer 22 (FIG. 4). Meanwhile, the base layer 20 and the polishing layer 22 form a porous material.

Referring to FIG. 4, the porous material (the base layer 20 and the polishing layer 22) is extruded by using high-temperature (110° C.) extrusion wheels 42, so as to squeeze out the excess third polymeric material, thereby enabling the second fibers 24 of the polishing layer 22 to be more compact, and enabling the surface of the polishing layer 22 to be flatter. In this step, the size of the pores between the second fibers 24 may be adjusted, and the thickness of the polishing layer 22 may also be adjusted.

Then, the porous material (the base layer 20 and the polishing layer 22) is dried under a condition of 100° C. to 150° C. by using an oven. Next, the third polymeric material on the second fibers 24 is cooled, so as to form a polymeric elastomer. In this embodiment, the porous material (the base layer 20 and the polishing layer 22) is extruded by using a room-temperature extrusion wheel, so as to be cooled. Meanwhile, the third polymeric material is cured into a polymeric elastomer.

Figure 5:
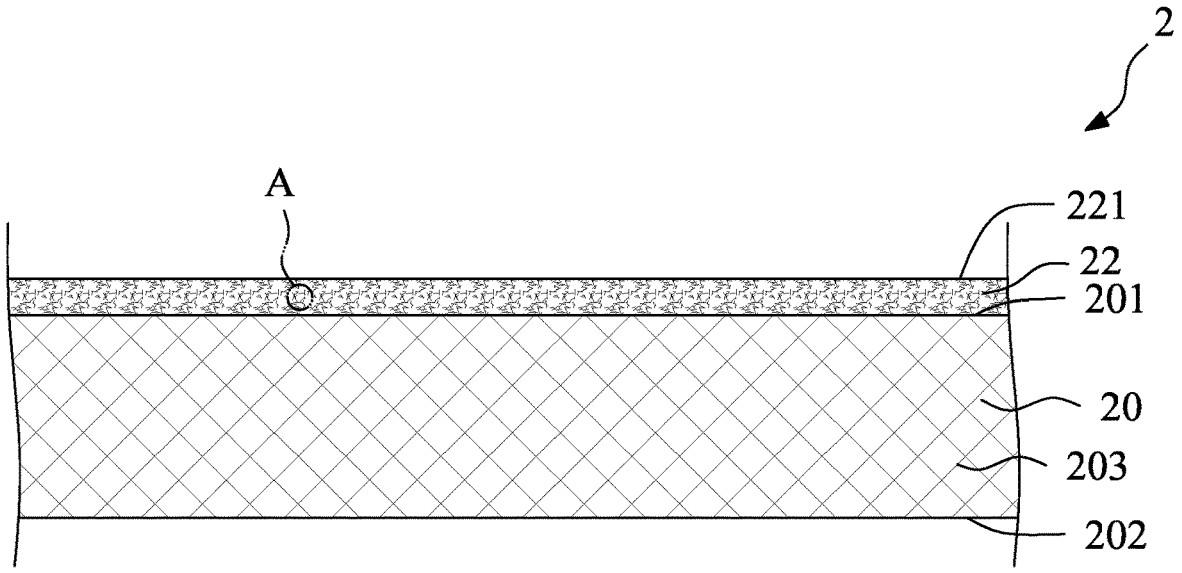

Next, the upper surface 221 of the polishing layer 22 is ground with a sandpaper, so as to produce a sense of fluff and enable the pores between the second fibers 24 to open on the upper surface 221 of the polishing layer 22, and to manufacture a polishing pad 2 of this embodiment (FIG. 5).

Figure 6:
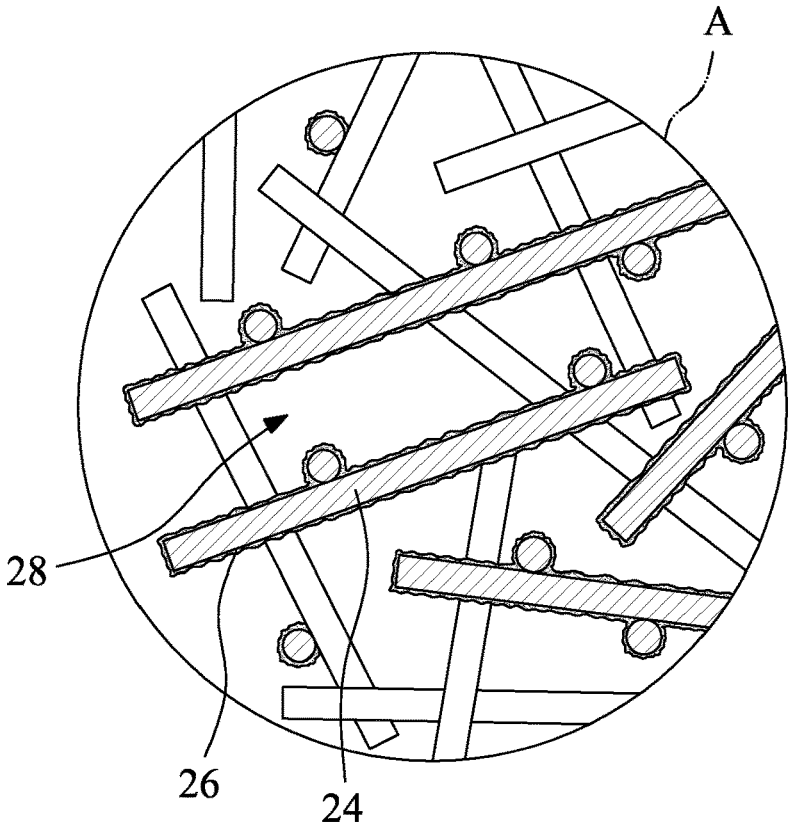
FIG. 6 is a partially enlarged schematic view of area A of FIG. 5.

FIG. 5 is a schematic cross-sectional view of a polishing pad according to an embodiment of the present invention. FIG. 6 is a partially enlarged schematic view of area A of FIG. 5. The density of the polishing pad 2 is 0.1 g/cm$^3$ to 0.44 g/cm$^3$, and the polishing pad 2 includes a base layer 20 and a polishing layer 22. The base layer 20 has a first surface 201, a second surface 202 and a plurality of first fibers 203. The first fibers 203 are formed by curing a first polymeric material, where the first polymeric material is selected from the group consisting of polyamide resin, polyethylene terephthalate (PET), nylon, polypropylene (PP), polyester resin, acrylic resin, polyacrylonitrile resin and thermoplastic urethane (TPU). The length of the first fibers 203 is 40 mm to 60 mm, preferably 51 mm, and the fiber fineness (e.g., diameter) of each of the first fibers 203 is 0.2 μm to 0.5 μm, preferably 0.4 μm.

The polishing layer 22 is disposed on the first surface 201 of the base layer 20, and has a plurality of second fibers 24, a polymeric elastomer 26 and a plurality of pores 28. The second fibers 24 are arranged irregularly and cross each other to form the pores 28. The polymeric elastomer 26 is attached to the second fibers 24 and does not fill the pores 28. The second fibers 24 are formed by curing a second polymeric material, where the second polymeric material is selected from the group consisting of polyamide resin, polyethylene terephthalate (PET), nylon, polypropylene (PP), polyester resin, acrylic resin, polyacrylonitrile resin and thermoplastic urethane (TPU). The polymeric elastomer 26 is formed by curing a third polymeric material, where the third polymeric material is selected from the group consisting of oriented polypropylene resin, polycarbonate resin, epoxy resin, phenolic resin, polyurethane resin and polystyrene resin.

The second fibers 24 are formed by melt blowing, as stated above. The fiber fineness (e.g., diameter) of each of the second fibers 24 is 0.01 mm to 1 mm, and the length of the second fibers 24 is 50 mm to 60 mm, preferably 55 mm. In this embodiment, the length of the first fibers 203 is less than or equal to that of the second fibers 24. It should be noted that, the polymeric elastomer 26 is attached to the second fibers 24.

The pores 28 have a plurality of openings on the upper surface 221 of the polishing layer 22, and the size of the openings is 0.01 μm to 1 μm. It is noted that, the pores 28 are not the conventional cells, but are defined by crossing of the second fibers 24. The pores 28 allow a grinding slurry and abrasive particles to come in and go out (i.e., pass through) during a grinding process or polishing process.

The polishing pad 2 of this embodiment has the following advantages. Firstly, the second fibers 24 of this embodiment are of a fluffy porous structure, and do not need to form the conventional cells; therefore, conventional fiber protrusion, fiber combination or balloon and other problems will not occur, which can thus improve the yield of the polishing pad 2 and reduce the manufacturing cost. Secondly, shapes and sizes of the pores 28 are uniform, so that the grinding slurry and the abrasive particles can easily come into and go out of the pores 28 during the grinding process or polishing process. Thirdly, it is not easy for the polishing pad 2 to pill, and it is not easy to scratch a workpiece to be polished. Fourthly, the thickness of the polishing pad 2 and the sizes of the pores 28 are adjustable, and thus the polishing pad 2 and the pores 28 can be customized.

An example is given below to describe the present invention in detail, but it does not mean that the present invention is only limited to content disclosed in the example.

EXAMPLE

At first, a non-woven fabric substrate having the thickness of 51 mm is provided, whose weight is 215 g/m$^2$ and density is 0.215 g/cm$^3$. The material of fibers of the non-woven fabric substrate is 100% of nylon, and the fineness thereof is 3 den.

Then, 300 g of polyethylene terephthalate (PET) is provided to a melt blowing device, where the melt blowing device, at a temperature of 26° C. and under an atmospheric pressure, heats the PET to 200° C., to enable the PET to be in a molten state. Then, the PET is injected in a manner of injection molding with a pressure of 5 psi by using a high-speed pressure spray nozzle, to be sprayed on the non-woven fabric substrate, so as to form the second fibers. The fiber fineness (e.g., diameter) of each of the second fibers is 0.01 mm to 1 mm.

Next, the non-woven fabric substrate and the second fibers thereon are impregnated in polyurethane resin with the viscosity of 200 cps, so as to form a polishing layer. Then, extrusion wheels of 2 kg/cm$^2$ at an interval of 0 mm are used to extrude the non-woven fabric substrate and the polishing layer, so as to squeeze out the excess polyurethane resin. Next, the non-woven fabric substrate and the polishing layer are dried by using an oven at 130° C. Then, they are cooled by the extrusion wheels at a room temperature, and meanwhile, the polyurethane resin is cured into a polymeric elastomer. Next, the upper surface of the polishing layer is ground with sandpaper, so as to produce a sense of fluff and enable the pores between the second fibers to open on the upper surface of the polishing layer. Thus, a polishing pad of this embodiment is obtained. The thickness of the polishing pad is 1.50 mm to 1.55 mm, and the size of the openings is 0.01 μm to 1 μm.

The above embodiments only describe the principle and the efficacies of the present invention, and are not used to limit the present invention. Therefore, modifications and variations of the embodiments made by persons skilled in the art do not depart from the spirit of the invention. The scope of the present invention should fall within the scope as defined in the appended claims.

What is claimed is:

1. A method for making a polishing pad, comprising the following steps:

(a) providing a base layer, wherein the base layer has a first surface and a second surface;

(b) heating a second polymeric material to a molten state;

(c) spraying the second polymeric material in the molten state on the first surface of the base layer, wherein the second polymeric material forms a plurality of second fibers, and the second fibers are arranged irregularly and cross each other to form a plurality of pores;

(d) impregnating the second fibers in a third polymeric material, so that the third polymeric material is attached to the second fibers and does not fill the pores, so as to form a polishing layer; and wherein a viscosity of the second polymeric material of the step (b) is greater than that of the third polymeric material of the step (d).

2. The method according to claim 1, wherein the base layer of the step (a) is a non-woven fabric and has a plurality of first fibers, and the length of the first fibers is less than or equal to that of the second fibers.

3. The method according to claim 1, wherein, in the step (c), the second fibers are injected by using a nozzle, and there is a relative movement between the nozzle and the base layer; after the step (c), the method further comprises a step of cooling the second fibers.

4. The method according to claim 1, wherein, in the step (d), the base layer and the polishing layer form a porous material, and after the step (d), the method further comprises:

(d1) extruding the porous material by using an extrusion wheel, so as to squeeze out the excess third polymeric material; and (d2) cooling the third polymeric material on the second fibers, so as to form a polymeric elastomer.

* * * * *